US011381919B2

(12) United States Patent
Aleksandrov

(10) Patent No.: US 11,381,919 B2
(45) Date of Patent: Jul. 5, 2022

(54) SPEAKER BOX AND SPEAKER

(71) Applicant: Svetlomir Aleksandrov, Hannover (DE)

(72) Inventor: Svetlomir Aleksandrov, Hannover (DE)

( * ) Notice: Subject to any disclaimer, the term of this patent is extended or adjusted under 35 U.S.C. 154(b) by 4 days.

(21) Appl. No.: 16/835,466

(22) Filed: Mar. 31, 2020

(65) Prior Publication Data

US 2020/0314546 A1 Oct. 1, 2020

(51) Int. Cl.

| | |
|---|---|
| ***H04R 9/02*** | (2006.01) |
| ***H04R 1/02*** | (2006.01) |
| ***H04R 9/06*** | (2006.01) |
| ***H04R 1/28*** | (2006.01) |

(52) U.S. Cl.

CPC ..... *H04R 9/022* (2013.01); *H04R 1/025* (2013.01); *H04R 1/2819* (2013.01); *H04R 1/2842* (2013.01); *H04R 1/2865* (2013.01); *H04R 9/06* (2013.01)

(58) Field of Classification Search

CPC ..... H04R 9/022; H04R 9/025; H04R 9/045; H04R 9/06; H04R 2201/021; H04R 5/02; H04R 1/025; H04R 1/2819; H04R 1/2842; H04R 1/2865; H04R 1/08; H04R 1/403; H04R 1/2826; H04R 1/345; H04R 1/2834; H04R 1/227; H04R 1/2857; H04R 1/02; H04R 2205/021; B60R 2011/0045; B60R 11/0217; H04S 7/40

USPC ..... 381/332, 87, 333, 334, 345, 349, 397

See application file for complete search history.

(56) References Cited

U.S. PATENT DOCUMENTS

| | | | | |
|---|---|---|---|---|
| 4,144,416 | A * | 3/1979 | Babb | H04R 9/022 381/349 |
| 7,684,585 | B2 * | 3/2010 | Kemmerer | H04R 9/022 381/397 |
| 7,878,296 | B2 * | 2/2011 | Lee | H04R 1/347 181/148 |
| 10,187,728 | B2 * | 1/2019 | Oliveira | H04R 9/022 |
| 2001/0037910 | A1 * | 11/2001 | Coffin | H04R 1/02 181/199 |
| 2005/0163334 | A1 * | 7/2005 | Suprapmo | H04R 1/2826 381/337 |
| 2007/0076912 | A1 * | 4/2007 | Griffiths | H04R 1/02 381/345 |

(Continued)

FOREIGN PATENT DOCUMENTS

| | | | |
|---|---|---|---|
| DE | 102015116660 | A1 | 4/2017 |
| GB | 2 322 500 | A | 8/1998 |
| JP | 2005277502 | A | 10/2005 |

*Primary Examiner* — Ahmad F. Matar
*Assistant Examiner* — Sabrina Diaz
(74) *Attorney, Agent, or Firm* — WC&F IP

(57) ABSTRACT

The present invention relates to a speaker box (1) having a speaker housing (2) and a speaker (3). The speaker (3) has a speaker chassis (4) having a flange ring (5) on the front side (6) of the speaker (3), and a magnet head (8) on the rear side (7), opposite the flange ring (5), of the speaker (3). The speaker (3) is attached, by way of its flange ring (5), to a metal plate (9) that at least partly covers the speaker housing (2) at the front. For simpler and more effective self-cooling, a section connected to the flange ring (5) and made from metal projects into the speaker housing (2) and forms a channel wall (10) of an air channel (11).

18 Claims, 17 Drawing Sheets

(56) References Cited

U.S. PATENT DOCUMENTS

| | | | | |
|---|---|---|---|---|
| 2009/0173567 | A1* | 7/2009 | Stiles | H04R 1/2849<br>181/148 |
| 2013/0213730 | A1* | 8/2013 | Litovsky | H04R 1/02<br>181/199 |
| 2014/0348369 | A1* | 11/2014 | Nevill | H04R 1/02<br>381/345 |
| 2015/0085441 | A1* | 3/2015 | Reilly | H04R 29/001<br>361/679.46 |

* cited by examiner

SPEAKER BOX AND SPEAKER

FIELD OF THE INVENTION

The invention relates to a speaker box having a speaker housing and a speaker.

The invention furthermore relates to a speaker having a speaker chassis that has a flange ring on the output side of the speaker, and having a magnet head on the rear side, opposite the flange ring, of the speaker.

Speakers are transducers that convert an electrical input signal into mechanical vibrations that are able to be perceived as sound. They are usually used to generate sound in order to play back music and speech. The typical operating frequency range of speakers is between around 50 Hz and 20 kHz.

A speaker box is the name given to the unit consisting of one of more speakers and a housing. Such speaker boxes also optionally contain a crossover network and insulating material in addition to wiring. If it additionally contains an amplifier, the speaker box is referred to as an active box.

Speakers, in particular the voice coils, through which current flows, of speakers, constitute a significant source of heat. The heat that is generated is dissipated in part into the air and in part into other speaker elements.

In particular in speaker boxes, the heat that arises is often able to be dissipated to the surroundings via the housing only to an insufficient extent, meaning that overheating occurs in the speaker box, in particular in the case of relatively high speaker powers, and speaker components may be damaged.

Various concepts have therefore already been developed in order to allow speakers and in particular speaker boxes to be cooled.

DE 10 2015 116 660 A1 describes a speaker structure having a frame, a diaphragm, a magnet and a voice coil. The airflows that are generated when playing back sound are guided away from the speaker in a targeted manner by non-return valves, wherein the warm airflows that are channeled away are not able to flow back into the speaker again.

GB 2 322 500 A discloses a portable electronic device such as for example a mobile telephone that has an integrated speaker. In order to channel the heat out of the inside of the housing of the electronic device, a small air tube is provided that channels the heat generated at the speaker into the surroundings. In this case, the airflows accompanying the generation of sound at the speaker and vibrational movements of the diaphragm are exploited in order to eject the heated air and draw cooler ambient air into the device.

JPH 6-233367 A discloses a speaker box that provides airflow channels on the rear side of the speaker in order to guide the warm airflows generated by the speaker out of the housing into ambient air.

Against this background, the object of the invention is to specify an improved speaker box that exhibits simpler and more effective self-cooling.

The object is achieved according to the invention by a speaker box having the features of claim 1 and the speakers having the features of claim 17. Advantageous embodiments are described in the dependent claims.

The present speaker box may be designed both as a simple speaker box and as an active box having one or more speakers. In this sense, the terms "a/an" in connection with this application should not be understood to be numbering terms, but rather to be an indefinite article with the meaning "at least one", such that a speaker box having a speaker may also comprise further, additional speakers. These may also be speaker boxes for domestic use or Hi-Fi requirements, but also powerful speaker boxes having a high sound output for public use, such as concerts for example. These also comprise compact speakers and column or standing speakers.

The speaker housing is preferably a bass reflex housing that uses the sound component radiated to the rear by the speaker by using a bass reflex channel as resonator. Other forms of speaker housing are however also included.

The speaker usually consists of a diaphragm, the drive unit and connection elements. The diaphragm is driven for example by way of a voice coil. In addition to the coil, the drive includes a magnet in whose field the coil vibrates. A speaker cage, as part of a speaker chassis, connects the magnet to a bead and a spider that guide the diaphragm.

The speaker in the present case has a speaker chassis having a flange ring on the output side of the speaker, and a magnet head on the rear side, opposite the flange ring, of the speaker. The speaker is attached to a housing part of the speaker housing by way of its flange ring.

There is provision that a section connected to the flange ring and made from metal projects into the speaker housing and forms a channel wall of an air channel.

The housing part of the speaker housing may be made from metal and project into the speaker housing by way of a section that forms a channel wall of an air channel.

As an alternative or in addition thereto, it is conceivable that the at least one air channel made from metal is formed in one piece (that is to say integrally) with the flange ring of the speaker chassis. In a speaker improved in this way, the flange ring may have at least one air channel formed with the flange ring and having channel walls, wherein the air channel extends from the flange ring in the direction of the rear-side plane, spanned by the magnet head, of the speaker.

By virtue of the section made from metal and connected to the speaker chassis and forming an air channel, heat is transferred firstly by convection via the airflows generated by the loudspeaker and exiting via the air channel of the housing and thus dissipating the heat, and secondly also directly via the channel wall and possibly the housing part of the speaker box. The section made from metal is connected to the speaker chassis and has a higher thermal conductivity in comparison with air, meaning that heat dissipation is improved significantly. By virtue of the attachment of the speaker to the housing part made from metal, or the integral design of the channel walls of the air channel with the flange ring, some of the heat that is generated is already reliably dissipated at the point of creation. By virtue of the one-piece formation of the channel wall of the air channel with the housing part or the flange ring, the air channel is formed in a particularly simple manner. The air flowing through the air channel may additionally already lead to improved heat dissipation due to the direct contact with the section made from metal, since the heat is distributed over the entire surface of the section due to the high thermal conductivity of the metal and is thus removed quicker over the entire length of the air channel.

The feature whereby the housing part is made from metal does not necessarily mean that the housing part consists entirely of a metal material. In principle, this is understood to mean a predominant two-dimensional or three-dimensional proportion of metal having for example a metal surface area or metal volume of more than 50%. It may also be understood to mean a predominant proportion of metal in terms of the material composition of the housing part when using a material mixture. In one particularly advantageous refinement, the housing part is produced completely from one or more metal materials in order to allow a particularly effective transfer of heat.

The housing part may be a housing front of the speaker housing. The housing front may be formed in one piece with the speaker housing. The housing front may however also be a specific component that is connected to the speaker housing in a detachable or non-detachable manner. The housing front is assigned to a front side of the speaker housing, wherein the front side of the speaker housing is assigned to the output side of the speaker.

It is however also conceivable for the housing part to be a housing rear side or a housing side wall of the speaker housing. The rear side of the speaker housing is assigned to a side opposite the output side of the speaker.

In general, the airflow through the air channel out of the speaker box is ensured not only by the temperature difference between the air inside the speaker box and external ambient air, but also by the vibrations caused by the speaker. The pressure differences in the air that arise locally in this case generate airflows depending on the diaphragm travel, wherein, in the case of a higher power of the speaker that leads to a greater amount of heat at the speaker, stronger airflows also arise. The present speaker box thus experiences dynamic convective self-cooling without additional active cooling components, such as for example blowers, being required.

In the case of the speaker box, the flow of heat preferably takes place from the voice coil to the housing part via the speaker chassis of the speaker, and at the same time by way of airflows via the interior of the speaker housing and the air channel of the speaker box.

The present structure is furthermore distinguished by improved acoustics in comparison with known airflow-cooled speaker boxes, since the resonance properties of the inside of the housing are not affected by inconveniently arranged air channels, and undesired vibration generators or sound generators, such as for example blowers, are dispensed with. The air channels may additionally at the same time serve as bass reflex ports. Such bass reflex ports, for acoustic reasons, are preferably arranged on the front side of the speaker box that is assigned to the output side of the speaker box and may be equated to the front side of the speaker housing. Bass reflex ports on the front side of the speaker box, in comparison with bass reflex ports on the rear side of the speaker box, in particular in the case of relatively large speaker boxes, have the advantage that there are no propagation time differences when radiating the front sound generated by the speaker and the bass reflex sound, which propagation time differences may lead to a distorted or unclear sound from the speaker box. What are known as built-in boxes additionally exclude the use of air channels that extend at the rear of the speaker, since the built-in boxes are delimited by a wall or ceiling at the rear and it is therefore impossible to exchange air with the surrounding atmosphere. If the air channels serve as bass reflex channels, it is necessary only to provide suitable dimensions of the air channel that are suitable with regard to the frequency and amplitude range of the speaker for bass reflections.

As well as this, the housing part according to the present structure may also serve as a support and attachment structure in what are known as floating arrangements of speaker boxes in which the speaker boxes are mounted suspended in the air on struts by way of suitable attachment means, for example.

The housing part may be formed from a metal plate. A very simple and nevertheless effective design of the housing part is thereby achieved. The metal plate has a large surface with comparatively little thickness, such that heat is transferred quickly and reliably from one side of the metal plate to the other side. As well as this, the metal plate is easy to produce and easy to process. By way of example, that section of the housing part forming the channel wall may be provided by bending the metal plate.

A hollow part may be molded onto the housing part. Such a hollow part may be formed for example as a tube open on both sides with a round or rectangular cross section. The hollow part forms the channel walls of the air channel. In the case of a tubular hollow part, a particularly favorable, in particular low-noise airflow is routed through the air channel as a result of the cylindrical channel shape. The tubes may have structures that increase the surface, such as fins, burls or fractal structures for increasing the cooling surface and thus for improving the cooling effect. The hollow part is in particular formed in one piece with the housing part, but may also be a specific component that is connected to the housing part in a detachable or non-detachable manner.

It is advantageous if the channel wall projects beyond the plane of the speaker defined by the bottom of the magnet head of the speaker and into the speaker housing. This embodiment not only supports optical concealment of the speaker and thus the attractive appearance of the speaker box, but also boosts the resonator function of the inside of the housing through the additional wall section.

In one particularly expedient embodiment, the length of the channel wall that is formed by that wall section of the housing part projecting into the speaker housing is greater than the height of the speaker as defined from the flange ring to the bottom of the magnet head. A comparatively large distance is thereby provided for the air channel, such that an acceleration and suction effect acts on the airflows present in the inside of the housing, in a manner comparable to a chimney effect, and said airflows are guided reliably and quickly out of the speaker box.

An embodiment in which two opposing channel walls protrude from the plane of the housing part next to the flange ring of the speaker and project into the speaker housing is advantageous. This also creates two opposing air channels that are available for channeling out the heated airflows and thus again significantly increase the amount of heat dissipated. On the other hand, the opposing arrangement of the channel walls may also lead to the formation of an air circuit in which cool air flows into the speaker box through one air channel and leaves said speaker box through the other air channel in the form of heated air. Such circulation may for example be supported by way of suitable valves, such as for example non-return valves, in the air channels.

It is expedient if an electronics unit for driving the speaker is installed on the channel wall in the interior of the speaker housing. The electronics unit, in addition to the voice coil, may constitute another heat source in speaker boxes that increases the temperature in the speaker box. By virtue of the direct arrangement of the electronics unit on that section of the housing part formed as channel wall, the high thermal conductivity of the housing part made from metal is exploited in order to cool the electronics unit. It is additionally a space-saving arrangement of the electronics unit inside the speaker box, in which it is not necessary to provide any additional holding or carrier unit for the electronics unit. As well as this, the electrical cables of the electronics unit are also able to be laid over a comparatively short distance on the inside of the housing part as far as the speaker, such that it is possible to use short electrical conductors.

According to one advantageous embodiment, as an alternative or in addition, an electronics unit for driving the speaker is arranged in the air channel defined by the channel wall. In this embodiment, the airflow emerging from the inside of the housing flows around the electronics unit, thereby efficiently cooling it. The electronics unit is furthermore visible in the air channel from the outside, and may accordingly have a display or interface for communicating with a user, for example a status LED or an optical interface, such as for instance an infrared interface. The resonance chamber of the speaker in the inside of the housing is furthermore not influenced by the electronics unit, since that section of the housing part forming the channel wall may form the reflector wall for the desired sound reflections.

An embodiment in which the electronics unit is arranged in the plane of the speaker housing, for example in the plane of the housing part, is also conceivable in principle. By way of example, the electronics unit may be arranged between the output side of the speaker and the housing opening for the air channel. In this embodiment too, it is easier to access the electronics unit from the outside, and a display or interface for communication with a user may be provided on the electronics unit.

Whereas speakers or their voice coils do not generate any heat without a signal being applied, the electronics unit undergoes constant heating, including during signal pauses or in a standby state. It is therefore particularly advantageous if the speaker is designed to generate sound signals outside the audible spectrum. The speaker is thereby able to generate an inaudible signal during signal pauses during which no speech or music is being output, which inaudible signal leads to air movements inside the speaker box. The electronics unit is thus able to be cooled continuously by convection. The inaudible signal may for example have a frequency of between 10 and 15 hertz.

It is expedient if cooling fins are arranged on the channel wall. These increase the surface of the channel wall and thus improve the transfer of heat to the surroundings, and thereby the desired cooling effect. The cooling fins may in particular already be formed in one piece with the housing part in order to improve the assembly of the speaker box and the transfer of heat between channel wall and cooling fins.

An embodiment in which the air channel has a fin structure that increases the surface of the channel walls is advantageous. The cooling effects of the fin structure and of the airflows that are channeled out thereby interact and thus permit a particularly efficient transfer of heat from the inside of the housing to ambient air.

According to one advantageous embodiment, the channel wall, formed by a section of the housing part, of the air channel is bent in a meandering shape. The meandering shape contributes to increasing the surface in the longitudinal extent of the channel wall, such that the transfer of heat via the channel wall into the air channel is improved.

It is particularly expedient in this case if the meandering bends in the channel wall are formed with a cross section transverse to the airflow direction, seen from the speaker housing towards the surroundings. The cooling effects of the meandering shape and of the airflows that are channeled out thereby interact and thus permit a particularly efficient transfer of heat from the inside of the housing to ambient air.

It is expedient if the air channel defined by the channel wall formed by that section of the housing part projecting into the speaker housing has a cross section that changes from the interior towards the exit region. In this case, the interior is assigned to the inside of the speaker housing, whereas the exit region represents the opening of the air channel into the surroundings. By virtue of changes in cross section, it is possible to influence the air speeds at particular points of the air channel. By way of example, the air channel may have a cross section that increases from the interior towards the exit region. Such an air channel increase, for example in the shape of a funnel, towards the surroundings contributes to lowering the pressure of the discharged airflows and thereby reduces additional noise possibly caused by the air movements upon exit from the speaker box. However, it is also equally conceivable, and expedient in certain embodiments, if the air channel has a cross section that decreases from the interior towards the exit region. Such an air channel decrease, for example in the shape of a funnel, towards the surroundings speeds up the airflows in the direction of the surrounding atmosphere, giving rise to a certain suction effect and speeding up or supporting cooling.

In one preferred embodiment, the speaker is a bass reflex speaker, a bandpass speaker or a horn speaker. The present invention is able to be applied with a particularly simple structure in the case of these forms of speaker, and displays the desired improved self-cooling effects without any noteworthy influence on the acoustic properties of the speaker.

According to one advantageous embodiment, the housing part and the speaker chassis are made from aluminum. Due to the particularly advantageous thermal conductivity of aluminum, the cooling effects that are achieved according to the invention are further increased. As well as this, the overall weight of the speaker box is reduced significantly in comparison with other material compositions, and an attractive appearance of the speaker box is additionally ensured. The reduction in weight is significant in particular for floating arrangements of speaker boxes in which the speaker boxes are mounted suspended in the air on struts by way of suitable attachment means, for example. Due to the fact that the chassis and the housing part consist of aluminum, undesired interactions between the materials of both components are avoided.

The advantages according to the invention are also achieved in particular for speaker housings having a plurality of speakers. This relates for example to column speakers and other forms of speaker box in which, in some cases, up to a hundred individual speakers are combined in a housing. The self-cooling effect is increased even further by a plurality of speakers, since a plurality of speakers cause local pressure differences due to their respective diaphragm travel, and the overall air movement inside the speaker box is thus amplified. Furthermore, speakers that themselves generate only little air movement, in particular tweeters, are also jointly cooled by the overall air movement in the speaker box and the common housing part. In this case, a few, preferably fewer than ten and even more preferably fewer than three air channels in the speaker box are sufficient to bring about the required heat dissipation or air circulation. Not every speaker in particular has to have a dedicated airflow channel in order to dissipate heat from the speaker.

BRIEF DESCRIPTION OF THE DRAWINGS

The invention will be explained in more detail below on the basis of exemplary embodiments along with the attached drawings. In each case schematically.

DETAILED DESCRIPTION

Figure 1:
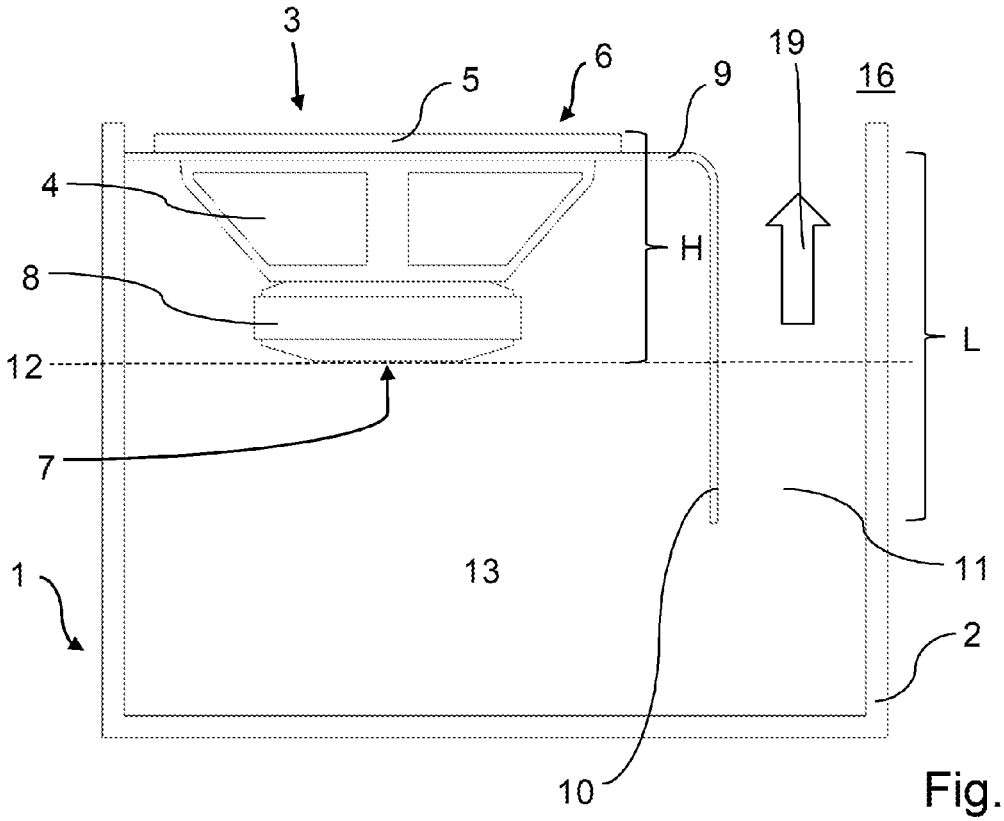
FIG. 1 shows a lateral sectional view of one embodiment of a speaker box having a speaker.

FIG. 1 shows a sectional view of the speaker box 1 according to the invention having a speaker housing 2 and a speaker 3. Further components usually present in a speaker box 1, such as for example electrical cables, drive units or mechanical attachment means, are not illustrated for the sake of clarity. The speaker 3 has a speaker chassis 4 in the form of a cage that supports the speaker diaphragm. The speaker 3 has a flange ring 5 for the attachment of the speaker 3 on an output side 6 of the speaker 3. The speaker 3 has a magnet head 8 on a rear side 7, opposite the flange ring 5, of the speaker 3. On the front side of the speaker housing 2 that is assigned to the output side 6 of the speaker 3, there is provided a housing part 9 made from metal that is connected to the speaker housing 2 and is attached to the speaker 3 via the flange ring 5. The speaker housing 2 in the present case is designed with a U-shape cross section and, together with the housing part 9, forms a substantially cuboidal housing. Other housing shapes, for example rounded ones, are however also conceivable for the speaker housing 2.

The housing part 9 is formed as a metal plate in the drawings. The housing part 9 is bent into the interior 13 of the speaker housing 2 in a region to the side of the speaker 3. That section of the housing part 9 projecting into the interior 13 forms a channel wall 10 of an air channel 11. The one-piece form of the channel wall 10 with the housing part 9 allows an air channel 11 that is particularly easy to produce and an optimum transfer of heat not only through the airflows 19 escaping from the speaker housing 2 through the air channel 11, but also via the adjoining housing part 9. In principle, however, a formation of a housing subsection that is not in one piece is also possible, in which for example that part of the housing part 9 forming the channel wall 10 is produced specially and is screwed to the housing part 9, for example using brackets. The air channel 11 forms an opening in the speaker housing 2 and allows air to be exchanged between the interior 13 of the speaker housing 2 and the surrounding atmosphere 16 surrounding the speaker housing 2.

During operation of the speaker 3, the speaker 3 heats up, in particular in the region of its voice coil, not illustrated. The heat is able to leave the speaker housing 2 firstly via the speaker 3 itself and the adjoining housing part 9 and secondly by convection through heat dissipation to the air surrounding the speaker 3. The diaphragm movement of the speaker 3 caused by applied signals generates air movements that promote the formation of airflows 19 that leave the speaker housing 2 via the air channel 11. As a result, the cooling of the interior 13 of the speaker housing 2 and thus also of the speaker 3 is improved. Due to the relatively strong air movements in the case of increased signal amplitude, which also leads to increased heating of the speaker 3, a stronger airflow 19 is also generated, and the cooling effect is increased. Dynamic self-cooling of the speaker box 1 is thus provided. The airflow direction of the airflows 19 normally runs in the air channel 11 from the interior 13 in the direction of the surrounding atmosphere 16, as illustrated by the arrow. Different airflow directions may however occur in the case of an air circulation that possibly arises in the case of at least two air channels 11, in which cool air from the surrounding atmosphere 16 enters the speaker box 1 and heated air from the interior 13 leaves via another air channel 11.

The housing part 9 made from metal has a high thermal conductivity. This therefore already leads to improved heat dissipation at the speaker 3 itself, which is attached to the housing part 9 via the flange ring 5. By virtue of forming the channel wall 10 for the air channel 11, faster cooling of the airflow 19 along the air channel 11 also takes place, since part of the heat is output from the airflow 19 to the housing part 9 and leaves the speaker housing 2 thereby.

In the exemplary embodiment, the housing part 9 is an aluminum plate that is able to be processed easily due to the material properties of aluminum, for example is able to be bent sectionally into the channel wall 10, has a low weight and is distinguished in particular by a particularly high thermal conductivity.

The interior 13 of the speaker box 1 is not only a reception space for the components of the speaker box 1, but also performs important acoustic functions for the sound quality of the speaker 3. The interior 13 in principle forms a resonance chamber for amplifying the sound waves output by the speaker 3. The interior 13 may furthermore form a bass reflex chamber that reflects sound waves of the speaker 3 radiated toward the rear in a targeted manner and thereby advantageously supplements the sound pattern of the speaker 3. The present structure allows the speaker box 1 to be cooled via an air channel 11 without the interior 13 and thus the resonance or bass reflex chamber being disadvantageously influenced. This is achieved by way of the channel wall 10 projecting from the housing part 9, which channel wall 10 forms a substitute reflection wall and allows the interior 13 to be screened in part from the air channel 11.

FIG. 1 shows an embodiment in which the channel wall 10 projects beyond the plane 12 of the speaker 3 defined by the bottom of the magnet head 8 of the speaker 3 and into the speaker housing 2. As a result, not only are the above-mentioned advantages of improved acoustics achieved through the formation of a substitute reflection wall, but sufficient optical concealment of the inside of the housing is also achieved. This prevents an observer from looking directly through the air channel 11 at the speaker 3 and the associated electronics.

The length L of the channel wall 10 that is formed by that section of the housing part 9 projecting into the speaker housing 2 is additionally greater than the height H of the speaker 3 as defined from the flange ring 5 to the bottom of the magnet head 8. As a result, the air channel 11, as may be seen in the figure, is comparatively long or takes up almost the entire length of the speaker housing 2. The airflow 19 is thus sufficiently directed and sped up within the air channel 11, such that the transfer of heat to the surrounding atmosphere 16 is improved.

Embodiments of the air channel 11 that have a length shorter than the height H are in principle however also conceivable.

Figure 2:
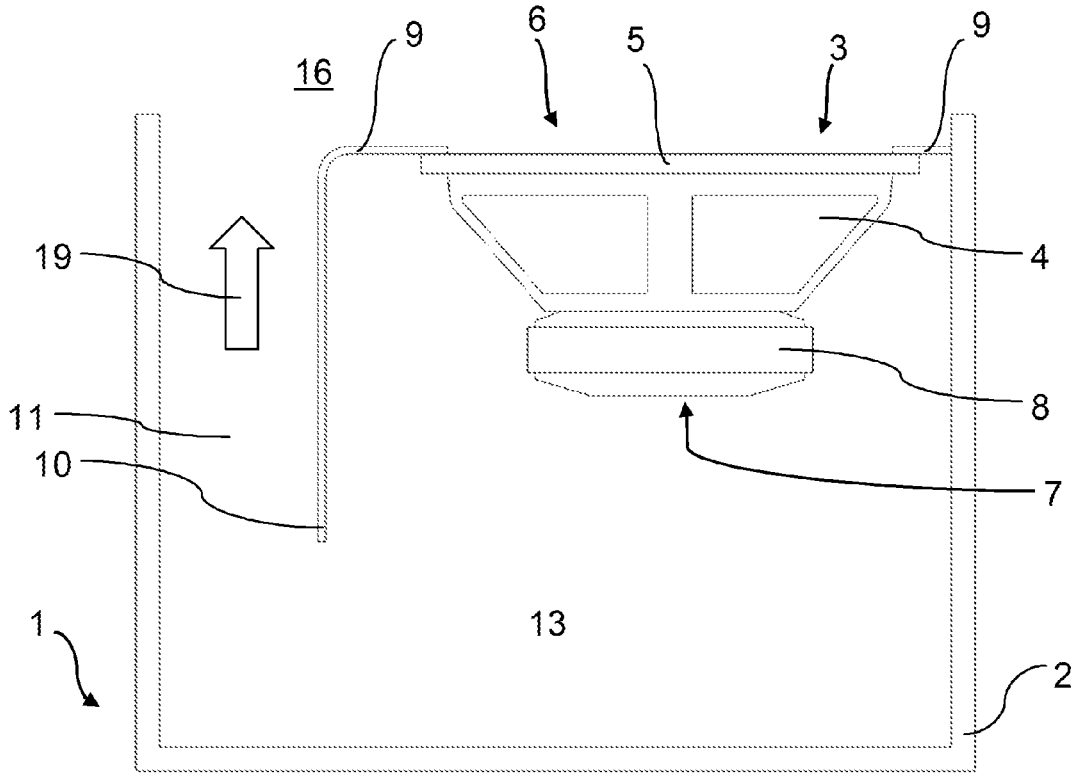
FIG. 2 shows a lateral sectional view of a further embodiment of the speaker box having a speaker.

The embodiment shown in FIG. 2 differs from the embodiment illustrated in FIG. 1 essentially in that the housing part 9 is not arranged between the flange ring 5 and the speaker chassis 4, as shown in FIG. 1, but the flange ring 5 in FIG. 2 directly adjoins the speaker chassis 4 and is connected at the end face to the housing part 9. In the region of the speaker opening on the output side 6 of the speaker 3, the housing part 9 has a recess in order not to impair the operation of the speaker 3. The embodiment shown in FIG. 2 allows a more attractive appearance of the speaker box 1, in the present case of the front side of the speaker box 1, since the flange ring does not protrude out of the plane of the housing part 9. Instead of this, the speaker 3, including the flange ring 5, is recessed into the speaker housing 2. The flange ring 5 is thus attached to the housing part 9 on an inner side, facing the interior 13, of said housing part.

Figure 3:
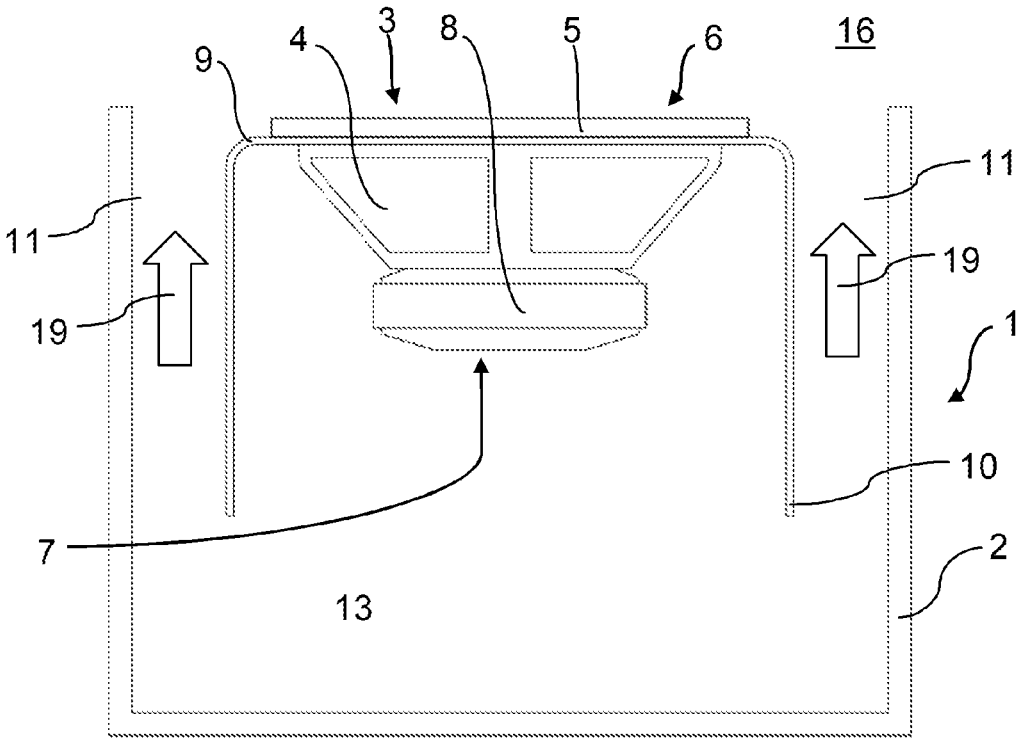
FIG. 3 shows a lateral sectional view of a further embodiment of the speaker box having a speaker.

The embodiment shown in FIG. 3 differs from the embodiment shown in FIG. 1 in that the housing part 9 is bent into the interior 13 at two opposing ends and thus forms channel walls 10 for two opposing air channels 11. The amount of heated air that is able to leave the speaker housing 2 per unit of time is thereby increased significantly. As well as this, it is conceivable to form an air circulation in which cool air enters through one of the two air channels 11 and heated air exits through the other air channel 11.

Figure 4:
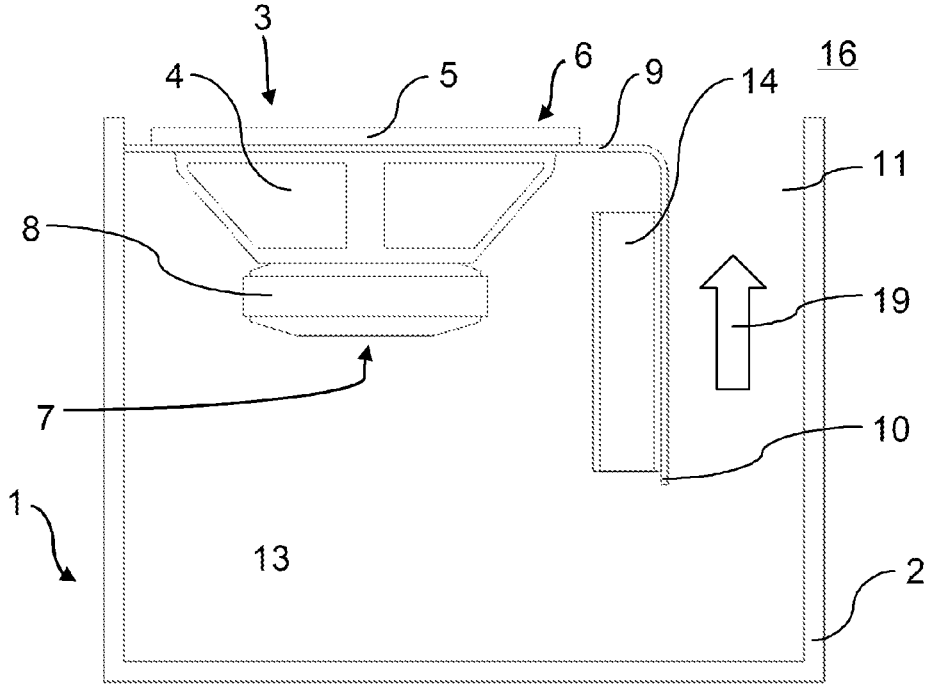
FIG. 4 shows a lateral sectional view of a further embodiment of the speaker box having a speaker and an electronics unit.

FIG. 4 essentially shows a speaker box 1 having the features described with regard to FIG. 1. In this embodiment, however, an electronics unit 14 for driving the speaker 3 is additionally arranged on the housing part 9, specifically on the channel wall 10 in the interior 13 of the speaker housing 2. As shown in the drawing, this may be arranged on a side, facing away from the air channel 11, of the channel wall 10. An arrangement of the electronics unit 14 on a side, facing the air channel 11, of the housing part 9 is in principle however also conceivable. The heat generated by the electronics unit 14 is not only dissipated by convection through air movements and the airflows 19, but also in particular via the directly adjoining housing part 9 that has a high thermal conductivity. If the housing part 9 or the channel wall 10 serves as support for the electronics unit 14, it is additionally not necessary to arrange any other carrier structures for the electronics unit 14 that could negatively influence the acoustic properties of the interior 13 in the interior 13.

Figure 5:
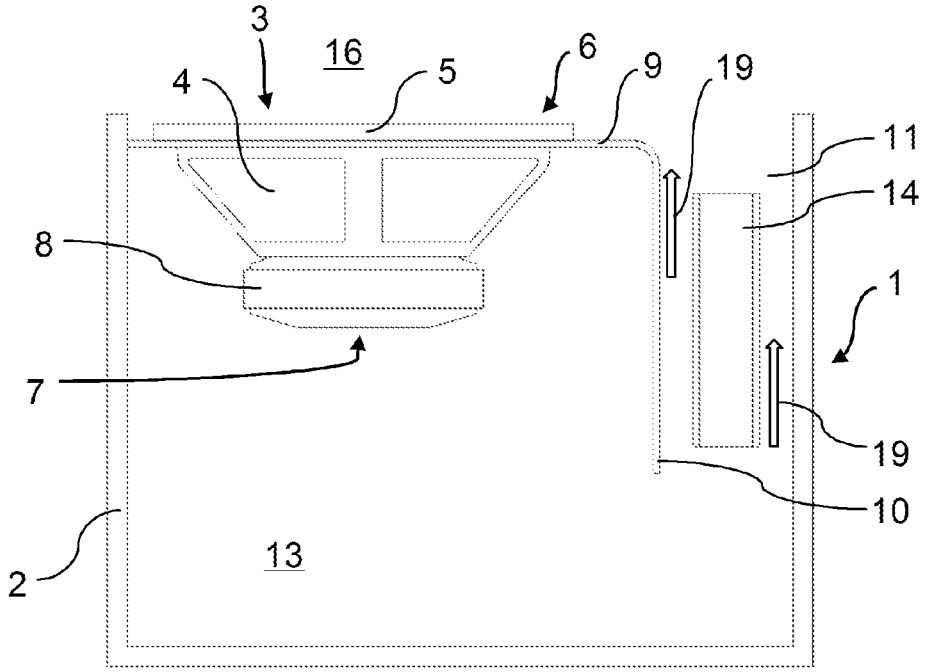
FIG. 5 shows a lateral sectional view of a further embodiment of the speaker box having a speaker and an electronics unit.

The acoustics of the speaker box 1 are improved further when the electronics unit 14 is arranged in the air channel 11, as in the embodiment shown according to FIG. 5. The resonance or bass reflex chamber is thereby kept free on the rear side 7 of the speaker 3. By virtue of the airflows 19 channeled in the air channel 11, the electronics unit 14 is cooled sufficiently by convection and does not require any additional active cooling units such as blowers for example.

Figure 6:
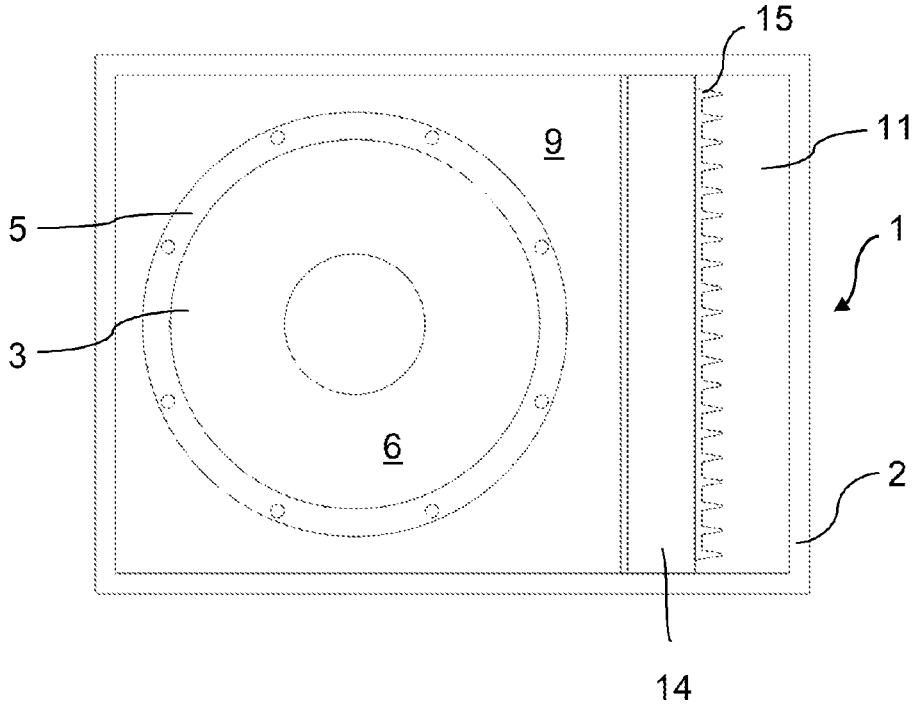
FIG. 6 shows a front view of a further embodiment of the speaker box having a speaker and an electronics unit.

FIG. 6 shows one embodiment in a front view of the speaker box 1, in which the electronics unit 14 is placed on the front side between the air channel 11 and the speaker 3, adjoining the housing part 9. This arrangement achieves a particularly high cooling efficiency for the electronics unit 14, since it firstly adjoins the housing part 9 made from metal and having a high thermal conductivity, secondly is cooled by the airflows 19 escaping from the air channel 11 and, as well as this, is in direct contact with the surrounding atmosphere 16 at the front side of the speaker housing 2. A display or interface for optical communication with a user may furthermore be provided on the electronics unit 14, since the electronics unit 14 in this embodiment is not concealed by housing parts and is also optically visible from different angles.

In FIG. 6, the housing part 9 is arranged on a front side, assigned to the output side 6 of the speaker 3, of the speaker housing 2. It is possible to see that section of the housing part 9 that is arranged in this case at the front and also the flange ring 5, attached to the housing part 9, on the output side 6 of the speaker 3. The air channel 11 is arranged to the side of the housing part 9 or of the speaker 3 and forms a visible opening within the speaker housing 2. According to one advantageous refinement, the air channel 11 has a fin structure 15 that increases the surface of the channel wall 10 in order to further increase the cooling effect.

Figure 7:
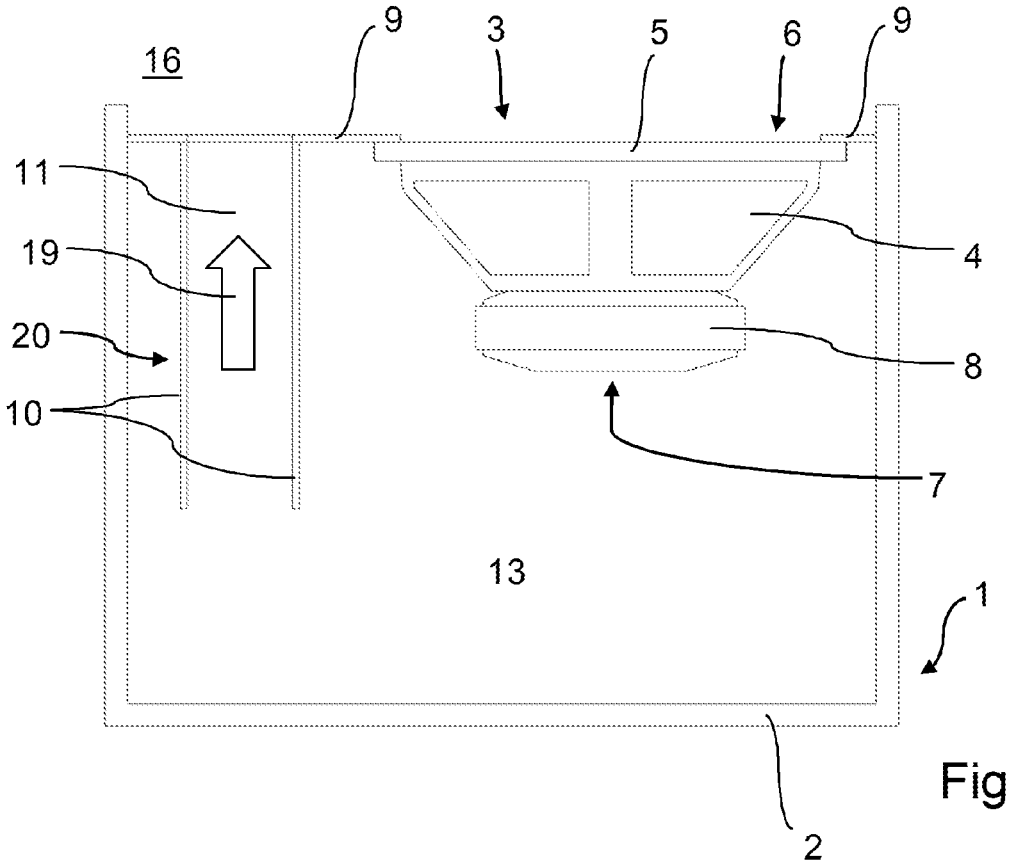
FIG. 7 shows a lateral sectional view of a further embodiment of the speaker box having a speaker.
Figure 8:
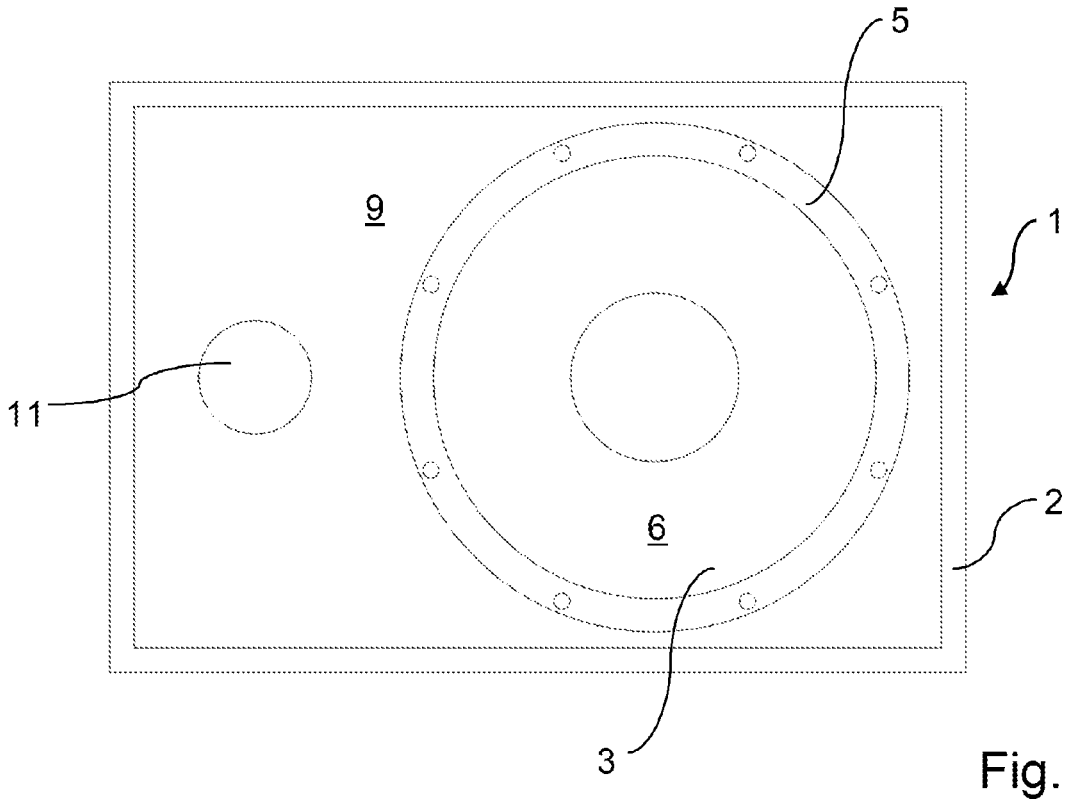
FIG. 8 shows a front view of the embodiment, shown in FIG. 7, of the speaker box having a speaker.

FIGS. 7 and 8 show a further embodiment of the speaker box 1 in which a hollow part 20 is molded onto the housing part 9. FIG. 7 shows a sectional side view, whereas FIG. 8 shows a front view of the front side of the speaker box 1. The hollow part 20 in FIGS. 7 and 8 is formed as a tube open on both sides with a round cross section and projects from the housing part 9 into the inside of the speaker housing 2. In this case, the hollow part 20 forms the channel walls 10 of the air channel 11, such that a tubular air channel 11 is provided in the present case. A particularly favorable, in particular low-noise airflow 19 is routed through the air channel 11 as a result of the cylindrical channel shape. In the same way as FIG. 2, the flange ring 5 is located in a plane that is offset in the direction of the interior 13 with respect to the plane of the housing part 9 in order to recess the speaker 3 into the speaker housing 2. The flange ring 5 is thus attached to the housing part 9 on an inner side, facing the interior 13, of said housing part.

Figure 9:
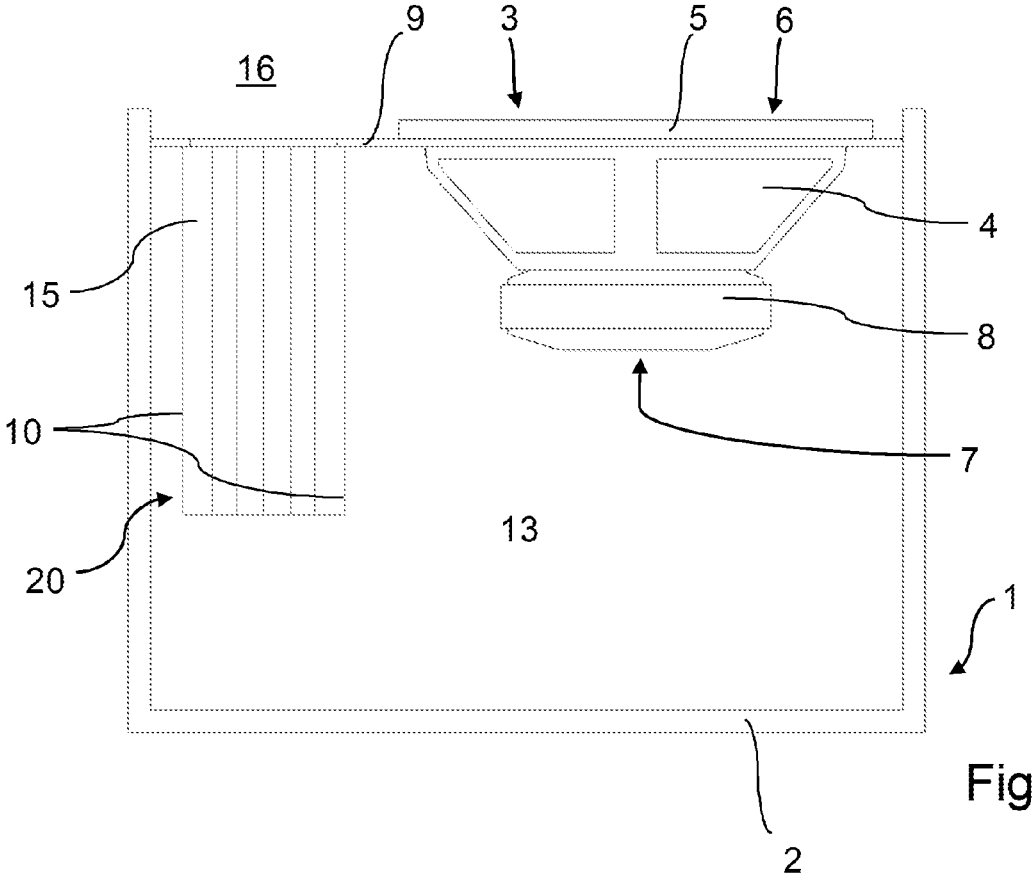
FIG. 9 shows a lateral sectional view of a further embodiment of the speaker box having a speaker.
Figure 10:
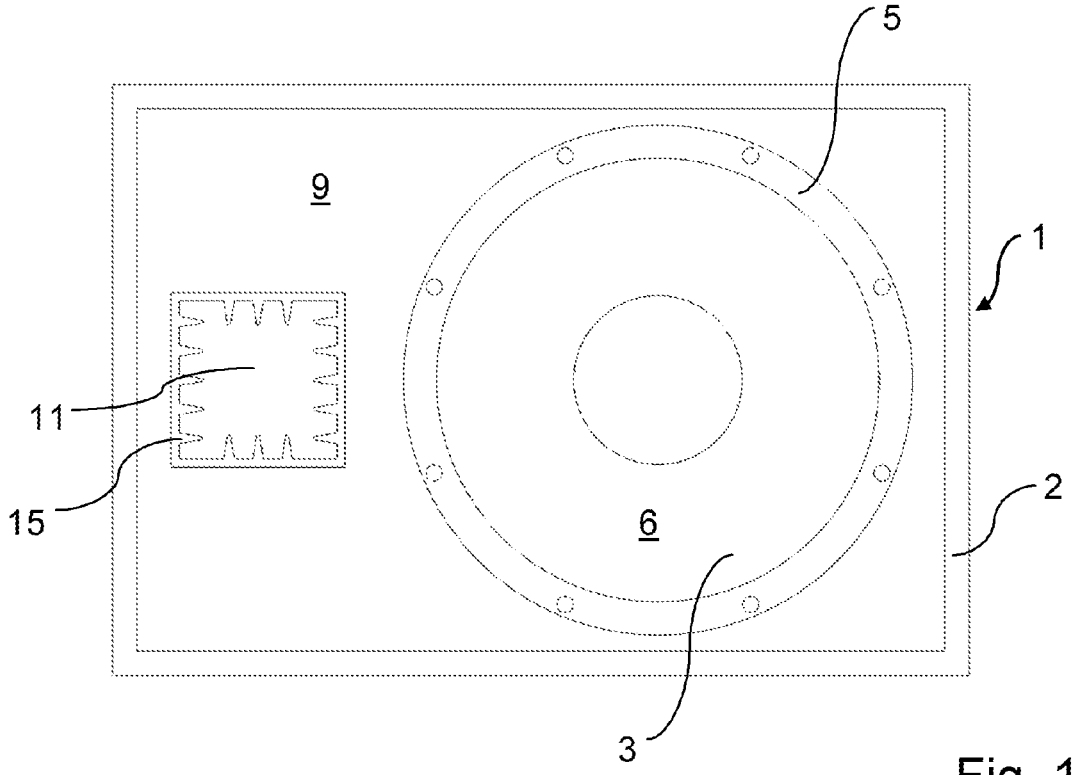
FIG. 10 shows a front view of the embodiment, shown in FIG. 9, of the speaker box having a speaker.

FIGS. 9 and 10 show a further embodiment of the speaker box 1 in which a hollow part 20 is molded onto the housing part 9. FIG. 9 shows a sectional side view, whereas FIG. 10 shows a front view of the front side of the speaker box 1. The hollow part 20 in FIGS. 9 and 10 is formed as a tube with fins that is open on both sides with a rectangular cross section and projects from the housing part 9 into the inside of the speaker housing 2. In this case, the hollow part 20 forms the channel walls 10 of the air channel 11, such that a tubular air channel 11 is provided in the present case. A particularly high cooling effect through the cooling channel 11 is achieved by the fin structure 15 on the channel walls 10.

FIGS. 11 to 14 show embodiments of the speaker box 1 having a plurality of speakers 3.

Figure 11:
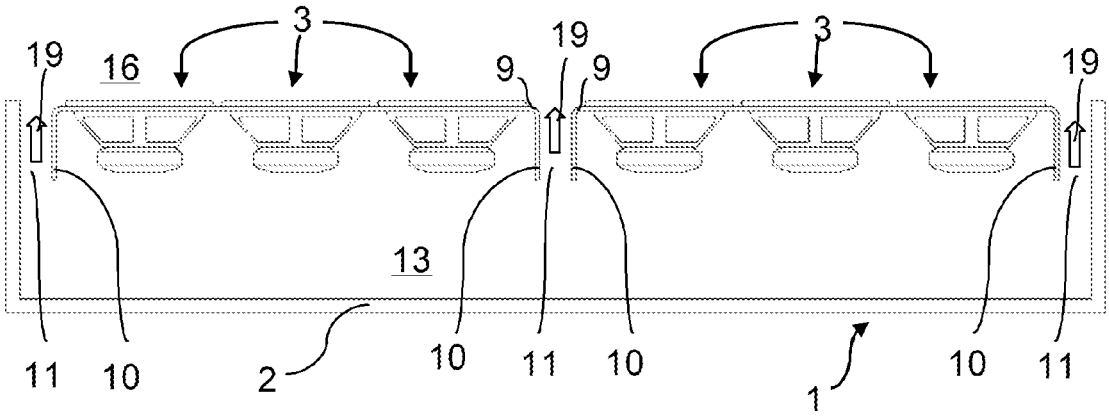
FIG. 11 shows a lateral sectional view of a further embodiment of the speaker box having a plurality of speakers.

FIG. 11 shows, by way of example, one embodiment of an elongate speaker box 1 having two rows of in each case three speakers 3 arranged next to one another. The speakers 3 of a respective row are connected to one another by a common housing part 9, wherein the housing part 9 has sections protruding into the interior 13 at two opposing ends and that each form an air channel 11 adjoining a channel wall 10. As illustrated, this results in a total of three air channels 11 that serve to channel heat out of the interior 13 of the speaker box 1 via airflows 19. In addition, heat generated by the speakers 3 is output directly to the housing parts 9, thereby forming overall a cooling concept that takes effect in several ways.

Figure 12:
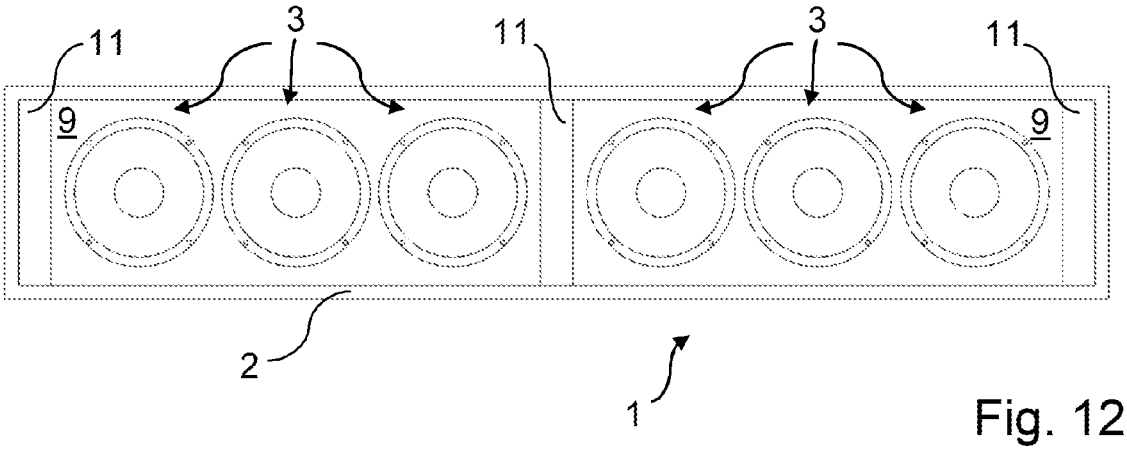
FIG. 12 shows a front view of the embodiment, shown in FIG. 6, of the speaker box having a plurality of speakers.

FIG. 12 illustrates the arrangement from FIG. 11 again in a front view that shows the two rows of speakers with the adjoining air channels 11 from the front perspective.

Figure 13:
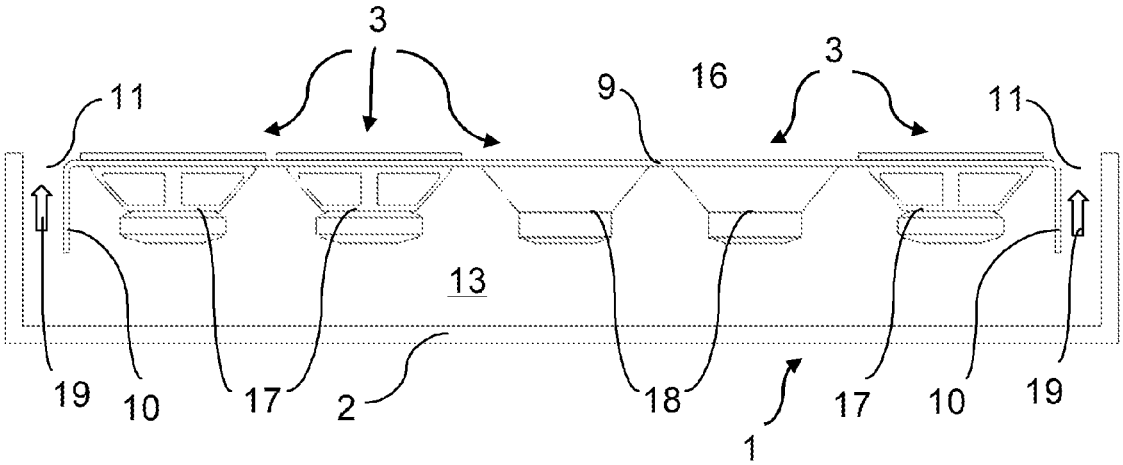
FIG. 13 shows a lateral sectional view of a further embodiment of the speaker box having a plurality of speakers.

FIG. 13 shows an embodiment with five speakers 3 arranged in a row in a sectional view. The row of speakers consists of three woofers 17 and two tweeters 18. All of the speakers 3 are connected to one another by a common housing part 9, wherein the housing part 9 has sections protruding into the interior 13 at two opposing ends and that each form an air channel 11 adjoining a channel wall 10. As illustrated, this results in a total of two air channels 11 that serve to channel heat out of the interior 13 of the speaker box 1 via airflows 19. In addition, heat generated by the speakers 3 is output directly to the housing part 9, thereby forming overall a cooling concept that takes effect in several ways.

The tweeters 18, just like the woofers 17, may be connected to the housing part 9 via flange rings. Other attachment options, such as for example clamping or adhesively bonding into an opening of the housing part 9, however also come into consideration for allowing the tweeters 18 to terminate flush with the housing part 9. When signals are applied, the tweeters 18 generate only very little diaphragm travel, and therefore also only little to no measurable air movement. In the present arrangement, however, they are cooled jointly by the airflows 19 generated by the woofers 17 in addition to the transfer of heat via the housing part 9, such that the cooling effect acts on all of the speakers 3 contained in the speaker box 1.

Figure 14:
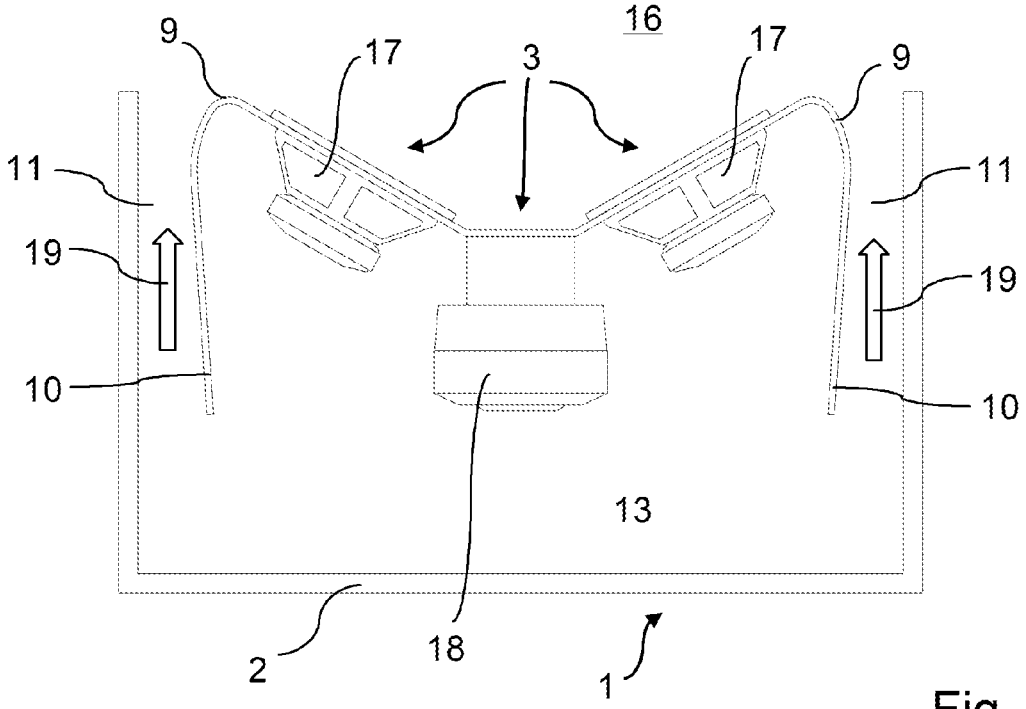
FIG. 14 shows a lateral sectional view of a further embodiment of the speaker box having a plurality of speakers.

FIG. 14 shows a speaker box 1 having three speakers 3 which, in contract to the arrangements shown in FIGS. 11 to 13, are not arranged in a plane, but rather placed at an angle to one another. The speaker box 1 has two woofers 17 and a tweeter 18 between them. The speakers 3 are connected to one another via a common housing part 9. For this purpose, the housing part 9 is bent multiple times in order to allow the speakers 3 to be set at different angles to one another and in order to form two opposing channel walls 10 for adjoining cooling channels 11. In this embodiment too, the tweeter 18 is cooled by way of a transfer of heat via the housing part 9 and by convection through the airflows 19 generated by the woofers 17. The channel walls 10 furthermore protrude into the interior 13 of the speaker housing 2, thereby forming a cross section of the air channels 11 that narrows from the interior 13 towards the exit region into the surrounding atmosphere 16. This tapering of the air channels 11 speeds up the airflows 19 in the direction of the surrounding atmosphere 16, giving rise to a certain suction effect and supporting the cooling.

Figure 15:
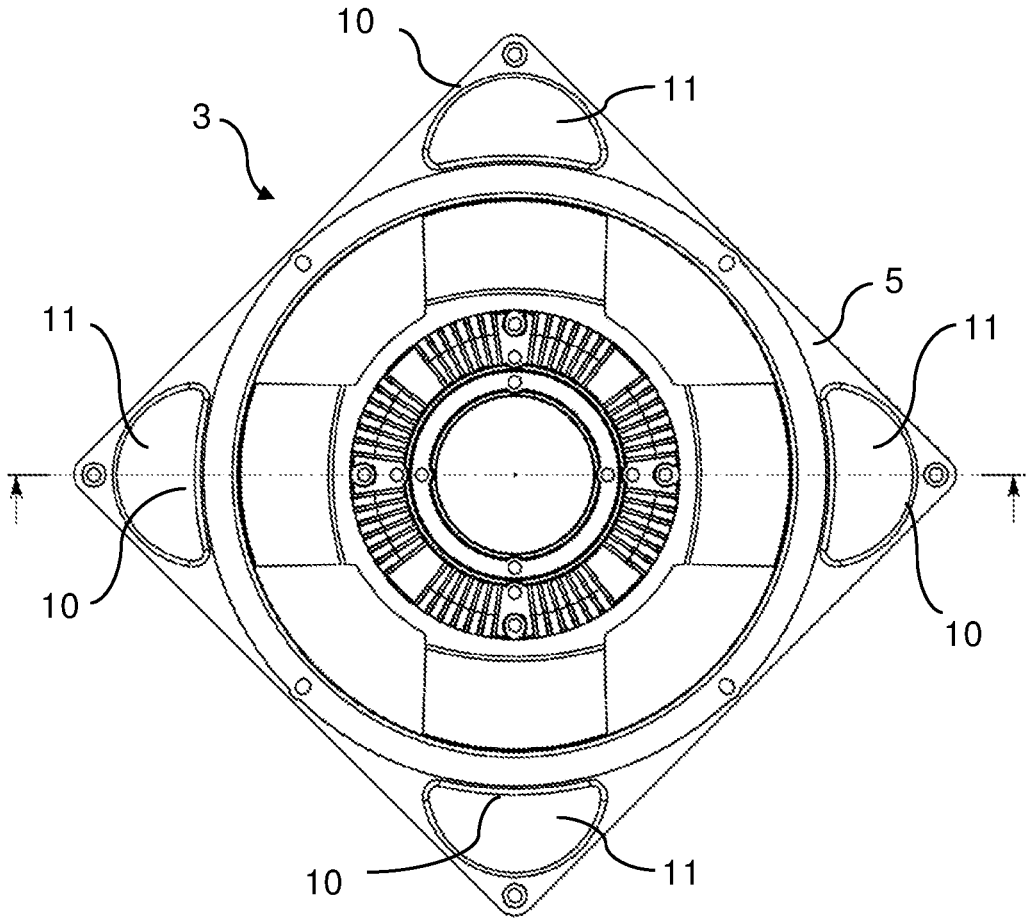
FIG. 15 shows a plan view of one embodiment of a speaker having integral air channels in the flange ring.

FIG. 15 shows a plan view of a bass reflex speaker 3 that has air channels arranged in a manner distributed over the circumference on its flange ring 5. These are arranged for example at the four corners of the flange ring 5, which had a square outer profile, and is formed integrally with the flange ring 5 made from metal. The air channels 11 are defined by channel walls 10 that form a circular segment-shaped or crescent-shaped cross section. Other cross-sectional surfaces are also however conceivable. The air channels 11 emerge at the output side of the speaker 3, that is to say the sound emission side, as visible in FIG. 15.

Figure 16:
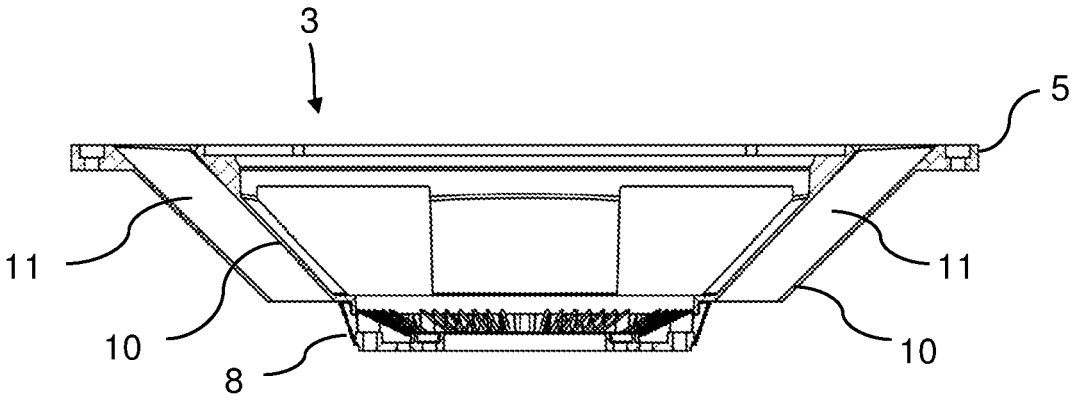
FIG. 16 shows a lateral sectional view of the speaker from FIG. 15.

FIG. 16 shows a lateral sectional view of the speaker 3 from FIG. 15. It is able to be seen that the air channels 11 extend from the plane of the flange ring 5 in the direction of the rear magnet head 8 or the plane spanned by the magnet head 8. By way of example, the channel walls 10 of the air channels 11 run approximately parallel along the speaker chassis 4, such that the air channels 11 run obliquely from the flange ring 5 to the magnet head 8. They may end before the magnet head 8, as illustrated, or be continued further towards the rear end of the magnet head 8 or beyond.

Figure 17:
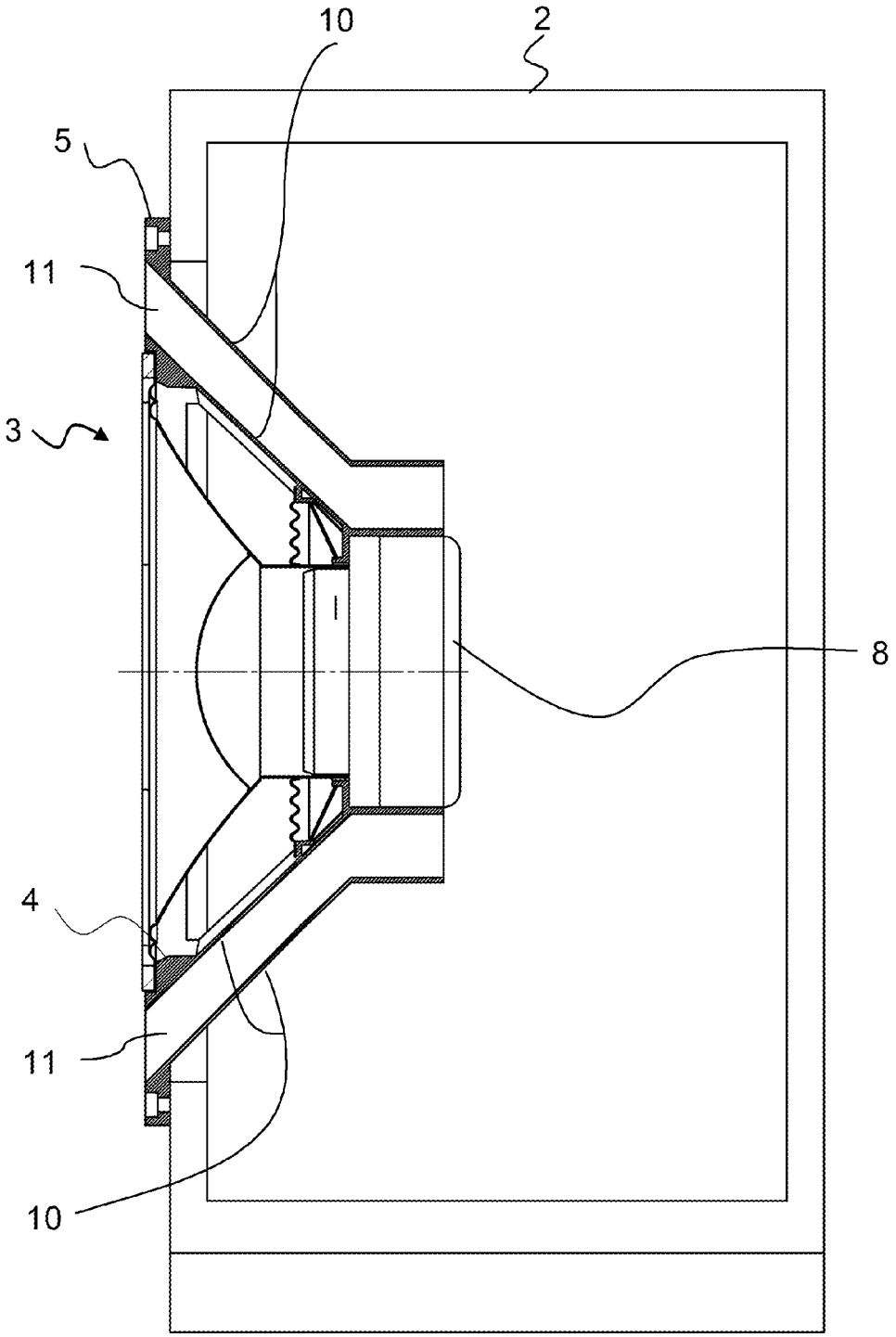
FIG. 17 shows a lateral sectional view of a further embodiment of the speaker box having a speaker having integral air channels in the flange ring.

FIG. 17 shows a lateral sectional view of a speaker housing 2 with a speaker 3 inserted at the front. In this case too, heat is dissipated not though the front housing part of the speaker housing 2, but rather through the air channels 11, formed integrally with the flange ring 5, having the associated channel walls 10 made from metal. In this exemplary embodiment, these are continued almost to the end of the magnet head 8 and angled at the magnet head 8, such that the air channels 11 first of all run diagonally from the output side and parallel to one another in the region of the magnet head 8.

Figure 18:
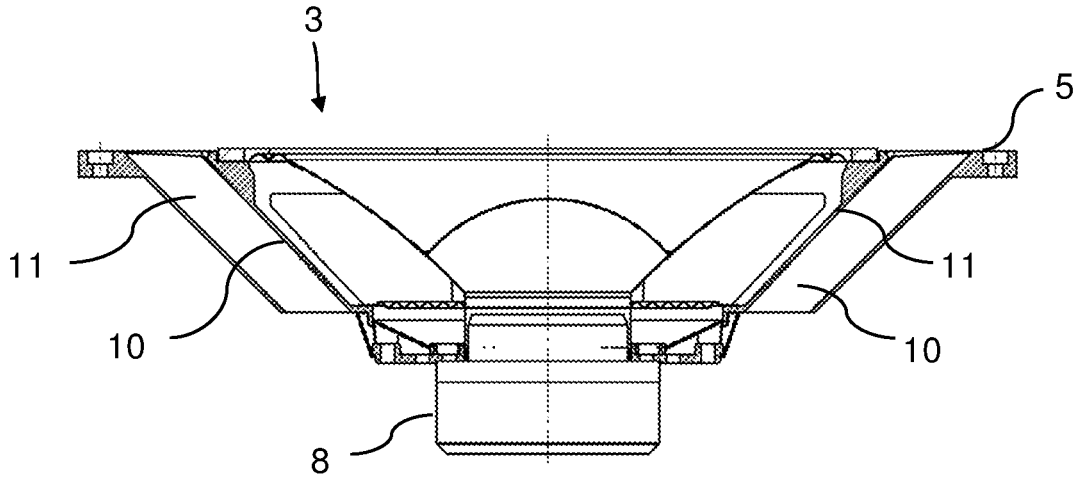
FIG. 18 shows a lateral sectional view of the speaker, shown in FIG. 17, having integral air channels in the flange ring.

FIG. 18 shows a lateral sectional view of a DAC speaker 3, in which the air channels 11 already end before the magnet head 8. The length, the cross section and the direction of extent, with any changes of direction, may be selected depending on the desired bass reflex properties.

Figure 19:
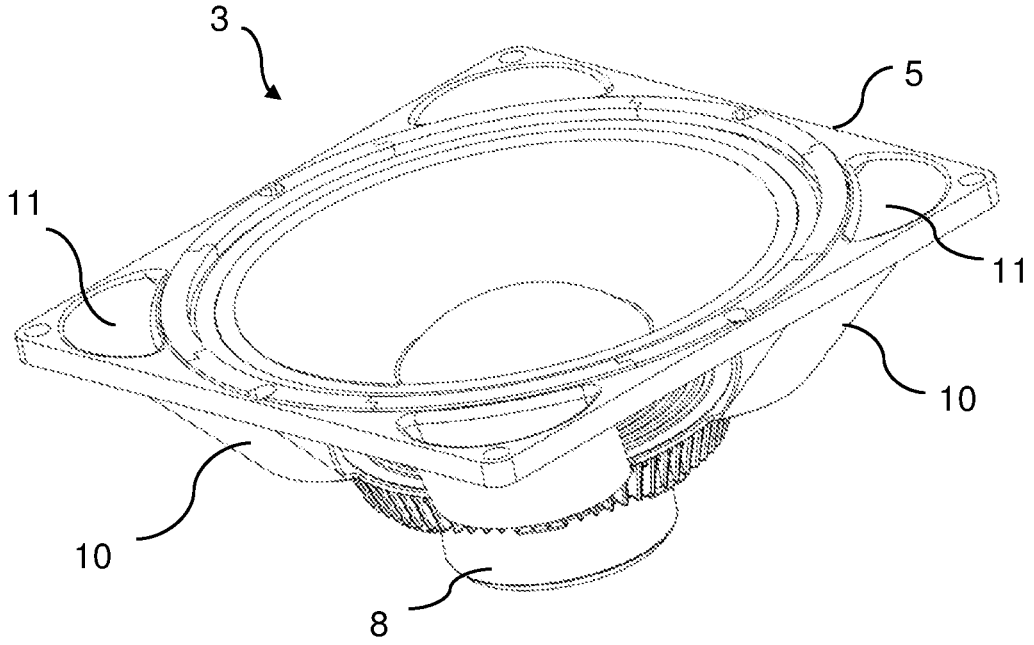
FIG. 19 shows a perspective view of the speaker from FIG. 18.

FIG. 19 shows a perspective view of the DAC speaker 3 from FIG. 18. It is able to be seen that the channel walls 10 of the air channels 11 emerge at the four corners of the flange ring 5 and are directed diagonally inwards towards the plane spanned by the magnet head 8. The air channels 11 then meet at a virtual common point of intersection that lies behind the magnet head 8 as seen from the flange ring 5 towards the magnet head 8. The channel walls 10 may in this case cling to the speaker chassis 4 or be formed integrally with those sections of the speaker chassis 4 extending from the flange ring 5 towards the magnet head 8.

LIST OF REFERENCE SIGNS

1 Speaker box
2 Speaker housing
3 Speaker
4 Speaker chassis
5 Flange ring
6 Output side (speaker)
7 Rear side (speaker)
8 Magnet head
9 Housing part
10 Channel wall
11 Air channel
12 Plane (bottom of magnet head)
13 Interior
14 Electronics unit
15 Fin structure
16 Surrounding atmosphere
17 Woofer
18 Tweeter
19 Airflow
20 Hollow part
H Height (speaker)
L Length (channel wall)

The invention claimed is:

1. A speaker box, comprising:

a speaker housing;

a speaker, wherein the speaker has a speaker chassis having a flange ring on an output side of the speaker and a magnet head on a rear side of the speaker opposite the flange ring;

a specific component formed from a metal plate, the specific component comprising a housing part which is connected to the flange ring and an end section that is bent to project into the speaker housing and forms a first channel wall of an air channel, said specific component being connected to the speaker housing, wherein the air channel is configured to promote convective heat loss from an interior of the speaker housing to an exterior of the speaker housing, and wherein the end section of the metal plate is configured to conductively transfer heat from the interior of the speaker housing to the housing part, and the housing part is configured to transfer heat to the exterior of the speaker housing.

2. The speaker box according to claim 1 further comprising a hollow tubular part molded onto the housing part forming an additional air channel.

3. The speaker box according to claim 1 wherein the metal plate is bent to project into the speaker housing from a plane of the housing part next to and on different sides of the flange ring of the speaker and forms the first channel wall of the air channel and a second channel wall of an additional air channel, the second channel wall opposing the first channel wall.

4. The speaker box according to claim 1 further comprising an electronics unit for driving the speaker arranged on the first channel wall in the interior of the speaker housing.

5. The speaker box according to claim 4 wherein the electronics unit for driving the speaker is arranged in the air channel defined by the first channel wall.

6. The speaker box according to claim 1 wherein the speaker is designed to generate sound signals outside an audible spectrum.

7. The speaker box according to claim 1 further comprising cooling fins arranged on the first channel wall.

8. The speaker box according to claim 1 wherein the air channel has a fin structure that increases the surface of the first channel wall.

9. The speaker box according to claim 1 wherein the first channel wall is bent in a meandering shape.

10. The speaker box according to claim 9, wherein the meandering shape includes bends of the first channel wall formed with a cross section transverse to an airflow direction, seen from the speaker housing into a surrounding atmosphere.

11. The speaker box according to claim 1 wherein the air channel has a cross section that changes from an interior region towards an exit region.

12. The speaker box according to claim 1 wherein the speaker is a bass reflex speaker, a bandpass speaker, or a horn speaker.

13. The speaker box according to claim 1 wherein the housing part and the speaker chassis are made from aluminum.

14. The speaker box according to claim 1 wherein the speaker housing has a plurality of additional speakers.

15. The speaker box according to claim 1 wherein the air channel has a first opening to the exterior of the speaker housing and a second opening to an interior space of the speaker housing in which the speaker is situated, wherein an unimpeded line of sight exists from the first opening to the second opening.

16. A speaker, comprising:

a speaker chassis that has a flange ring on an output side of the speaker, said flange ring having a first diameter, and a magnet head on a rear side of the speaker opposite the flange ring, said magnet ring having a second diameter smaller than the first diameter of the flange ring, wherein the flange ring has air channels which extends obliquely from the flange ring at the first diameter to at least the magnet head at the second diameter, wherein the air channels have surrounding channel walls, and wherein the channel walls cling to the speaker chassis or are formed integrally with sections of the speaker chassis extending from the flange ring to at least the magnet head, thus allowing heat to be dissipated through the air channels having the associated channel walls made from metal.

17. The speaker according to claim 16, wherein the air channels includes a plurality of air channels which are distributed at four corners of the flange ring.

18. A speaker box, comprising:

a speaker housing;

a speaker comprising a flange ring on an output side of the speaker and a magnet head on a rear side of the speaker opposite the flange ring;

a bent metal plate comprising a first part that is an exterior surface of the speaker housing and a second part that projects into the speaker housing beyond a plane of the speaker defined by a bottom of the magnet head, wherein the first and second parts are to either side of a bend in the bent metal plate, wherein the flange ring of the speaker is connected to the first part of the bent metal plate;

an air channel formed by the second part of the bent metal plate and a wall of the speaker housing spaced apart from the second part, wherein the second part of the bent metal plate is between the wall and the speaker, wherein the bent metal plate is a reflection wall to the speaker, wherein an unimpeded line of sight exists from the magnet head to a terminal end of the second part of the bend plate furthest from the bend, wherein the air channel is configured to promote convective heat loss from an interior of the speaker housing to an exterior of the speaker housing, and wherein the second part of the bent metal plate is configured to conductively transfer heat from the interior of the speaker housing to the first part of the bent metal plate, and the first part is configured to transfer heat to the exterior of the speaker housing.

* * * * *